US007941072B2

(12) United States Patent
Ishikawa et al.

(10) Patent No.: US 7,941,072 B2
(45) Date of Patent: May 10, 2011

(54) CARTRIDGE

(75) Inventors: Satoru Ishikawa, Kitanagoya (JP); Takeyuki Takagi, Nagoya (JP); Fumio Morita, Ichinomiya (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 502 days.

(21) Appl. No.: 12/163,336

(22) Filed: Jun. 27, 2008

(65) Prior Publication Data

US 2009/0000423 A1 Jan. 1, 2009

(30) Foreign Application Priority Data

Jun. 29, 2007 (JP) ..... 2007-173417

(51) Int. Cl.
*G03G 15/00* (2006.01)

(52) U.S. Cl. ..... 399/107; 399/111; 399/119

(58) Field of Classification Search ..... 399/107, 399/111, 119

See application file for complete search history.

(56) References Cited

U.S. PATENT DOCUMENTS

| | | | | |
|---|---|---|---|---|
| 2006/0193646 | A1 | 8/2006 | Suzuki et al. | |
| 2008/0205911 | A1 * | 8/2008 | Ishikawa et al. | 399/12 |
| 2008/0205928 | A1 * | 8/2008 | Ishikawa | 399/111 |

FOREIGN PATENT DOCUMENTS

| | | |
|---|---|---|
| JP | 2006-267994 | 10/2006 |

* cited by examiner

*Primary Examiner* — Ryan D Walsh
(74) *Attorney, Agent, or Firm* — Banner & Witcoff, Ltd.

(57) ABSTRACT

A cartridge includes; a first gear rotatably provided at the casing; a second gear including a toothed portion and a toothless portion; and a storing portion configured to store the second gear. The second gear includes an arm that is flexible and extends substantially along a peripheral direction of the second gear. An inner peripheral surface of the storing portion includes a bulging portion that bulges inward in a radial direction. The bulging portion has a peak portion closest to a rotation center of the second gear. The arm is deflected while the arm contacts the bulging portion. The deflection of the arm is changed from an increasing tendency to a decreasing tendency at the peak portion as a base point. The toothed portion of the second gear is separated from the first gear when the end portion of the arm has crossed over the peak portion.

7 Claims, 8 Drawing Sheets

CARTRIDGE

CROSS-REFERENCE TO RELATED APPLICATIONS

This application is based upon and claims the benefit of priority from Japanese Patent Application No. 2007-173417, filed on Jun. 29, 2007, the entire contents of which are incorporated herein by reference.

TECHNICAL FIELD

One aspect of the present invention relates to a cartridge detachably attachable to an image forming apparatus which can perform new product detection and type detection.

BACKGROUND

In general, in an image forming apparatus such as a laser printer, a cartridge containing toner is detachably attached to a main body of the apparatus. For example, JP-A-2006-267994 discloses an image forming apparatus capable of determining whether the attached cartridge is a new product (new product detection) and also determining type of the cartridge (type detection).

Specifically, an image forming apparatus disclosed in JP-A-2006-267994 includes an arm-shaped swayable actuator, a spring for urging the actuator to a neutral position, a sensor for detecting a swing of of the actuator, and a controller the new product detection and the type detection based on a signal from the sensor, all of which are provided in a main body of the apparatus. A cartridge attached to the image forming apparatus includes: one or two contact projections that extend radially outward from a predetermined shaft portion; a detection gear that rotates integrally with the contact projection(s) around the shaft portion; and a gear mechanism that meshes with the detection gear and that transmits driving force to a stirring plate (agitator) in the cartridge.

In the image forming apparatus, when the cartridge is attached to the main body of the apparatus, the contact projection(s) presses one end of the actuator thereby the actuator swings. The sensor detects the swing of the actuator. A signal detected by the sensor is transmitted as a first detection signal to the controller. Upon receipt of the first detection signal, the controller determines the cartridge is a new product.

In the image forming apparatus, when, for example, a front cover is closed after attachment of a cartridge, the controller performs warm-up operation (idle rotation operation). The term "idle rotation operation" means an operation to rotate the agitator in order to agitate toner contained in the cartridge.

In such idle rotation operation, a transmission force from a drive source provided in the main body of the apparatus is transmitted to the agitator and the detection gear in the cartridge by way of the gear mechanism. As a result, the agitator starts agitation of toner, and the contact projection(s) rotates to further push the one end of the actuator. Thereby, the contact projection(s) is separated from the actuator at a predetermined position. Subsequently, the actuator returns to a neutral position by means of urging force of the spring. At this time, when two contact projections are provided, the second contact projection presses the one end of the actuator again to allow the actuator to swing. The swing of the actuator is detected by the sensor. A signal detected by the sensor is transmitted as a second detection signal to the controller.

Upon receipt of the second detection signal, the controller determines the type of the cartridge to be type A (e.g., a type where the maximum sheets to be printed are 6000). When the second detection signal is not received, the controller determines the type of the cartridge to be type B differing from type A (i.e., a type in which the maximum sheets to be printed are 3000).

When the detection gear rotates by a predetermined amount after the second contact projection has swayed the actuator, the detection gear is disengaged from a gear mechanism and does not rotate. Thereby, when a used cartridge is temporarily removed and again attached to the main body of the apparatus, the actuator does not swing by the contact projection, and hence the controller determines that the cartridge is an old product on condition that the detection signal is not transmitted at all.

With reference to FIGS. 8 and 9, an example detection gear will be described. As shown in FIG. 8, a detection gear CG has contact projections TB and a gear tooth portion GT is provided in only a portion of an outer periphery of the gear, whereby a remaining portion of the gear becomes a toothless portion NT. Thus, as shown in FIG. 9, the detection gear CG is configured such that, when the gear tooth portion GT is disengaged from the gear mechanism (only one transmission gear TG is illustrated), the gear does not rotate any further.

As shown in FIG. 8, an elastically-deformable rib R is formed in the detection gear CG so as to extend in an axial direction, and a V-shaped projecting portion B that deforms the rib R in a radially internal direction is formed in a case C that supports the detection gear CG shown in FIG. 9. As shown in FIGS. 9A to 9C, the rib R gradually becomes deformed toward radially inward direction during a movement from a base end of the V-shaped projection portion B to an apex thereof. After crossing the apex, the rib R gradually restores its original shape by means of restoration force. In the structure shown in FIG. 9, the detection gear CG independently rotates by utilization of the restoration force of the rib R acting on an inclined surface of the projection portion B. As a result, when the rib R crosses the apex of the projecting portion B, the transmission gear TG is disengaged from the gear tooth portion GT. Thus, the detection gear CG independently rotates by means of restoration force of the rib R after crossing the apex, whereupon the gear tooth portion GT departs from the transmission gear TG. As a result, the gear tooth portion GT and the transmission gear TG are prevented from again engaging with each other.

However, in the detection gear CG, the rib R may be deformed in a radially inward direction at the apex of the projection B as well as being deformed in a direction opposite to the rotating direction of the detection gear CG as a result that the rib R is caught by the apex. In this case, the rib R does not reach the inclined surface of the projection B (i.e., a inclined surface of the detection gear CG provided on a downstream side in the rotating direction), and hence a portion of the gear tooth portion GT of the detection gear CG remains meshed with the transmission gear TG. In a case where a portion of the gear tooth portion GT and the transmission gear TG remain meshed with each other, when the image forming apparatus is subsequently operated normally, flipping sound generates at an area where the transmission gear TG and the detection gear CG mesh with each other.

SUMMARY

Accordingly, one aspect of the present invention provides a cartridge capable of preventing engagement of a transmission gear with a toothless gear after a new product detection thereby preventing generation of flipping sound.

According to an aspect of the invention, there is provided A cartridge comprising: a casing; a first gear rotatably provided at the casing; a second gear including a toothed portion and a toothless portion, the toothed portion being provided on a part of an outer periphery of the second gear and configured to mesh with the first gear, and the toothless portion being provided on a remaining part of the outer periphery of the second gear and configured to be free from meshing with the first gear; and a storing portion formed at the casing and configured to store the second gear, the storing portion including an inner peripheral surface that faces the second gear, wherein the second gear comprises an arm that is flexible and extends substantially along a peripheral direction of the second gear, wherein the inner peripheral surface includes a bulging portion that bulges inward in a radial direction of the second gear and is allowed to contact an end portion of the arm, wherein the bulging portion has a peak portion that is closest to a rotation center of the second gear, wherein the arm moves in association with a rotation of the second gear in one direction and is deflected while the arm contacts the bulging portion, wherein a change tendency of deflection amounts of the arm is changed from an increasing tendency to a decreasing tendency at the peak portion as a base point, and wherein the toothed portion of the second gear is separated from the first gear when the end portion of the arm has crossed over the peak portion of the bulging portion in the one direction.

DESCRIPTION

Figure 1:
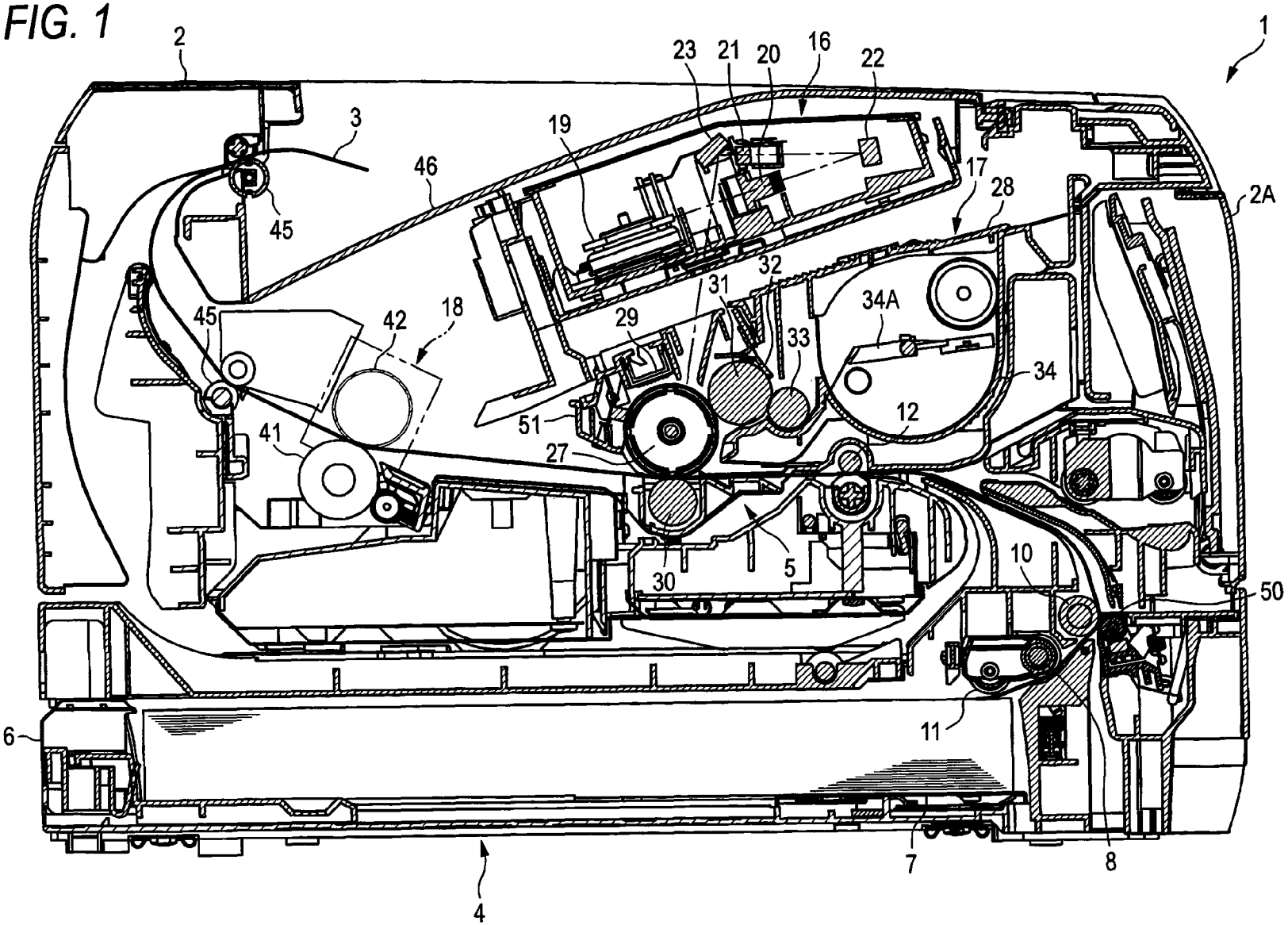
FIG. 1 is a side cross-sectional view showing a laser printer of an embodiment of the present invention.

Embodiments of the present invention will now be described in detail with reference to the drawings. FIG. 1 is a side cross-sectional view showing a laser printer of an embodiment of the present invention. In the following descriptions, after brief description of the overall configuration of a laser printer, details of the configuration will be described in detail. In FIG. 1, a right side is referred to be a "front side," and a left side is referred to be a "rear side." A side away from a viewer in a vertical direction of a sheet is referred to be a "right side," and a side close to the viewer in the vertical direction of the sheet is referred to be a "left side." A vertical direction is referred to be as illustrated.

<Overall Configuration of Laser Printer>

As shown in FIG. 1, a laser printer 1 serving as an example of an image forming apparatus has a feeder unit 4 configured to feed a sheet 3 into a main body casing 2, an image forming unit 5 configured to form an image on the sheet 3 fed by the feeder unit 4.

<Configuration of the Feeder Unit>

The feeder unit 4 includes a sheet feeding tray 6 removably attached to a bottom in the main body casing 2, and a sheet press plate 7 provided in the sheet feeding tray 6. The feeder unit 4 includes a delivery roller 11 disposed above one side end portion of the sheet feeding tray 6; a sheet feeding roller 8 disposed downstream of the delivery roller 11 in the conveying direction of the sheet 3; a pinch roller 10; and a paper dust removal roller 50. Further, the feeder unit 4 has a registration roller 12 provided downstream of the paper dust removal roller 50.

In the feeder unit 4, the sheet 3 in the sheet feeding tray 6 is aligned to the delivery roller 11 by the sheet press plate 7 and delivered to the sheet feeding roller 8 by the delivery roller 11. The sheets 3 are delivered one at a time by the sheet feeding roller 8 and conveyed to the image forming unit 5 after passing through the respective rollers 10, 50, and 12.

<Configuration of the Image Forming Unit>

The image forming unit 5 includes a scanner unit 16, a process cartridge 17 and a fixing unit 18.

<Configuration of the Scanner Unit>

The scanner unit 16 is disposed at an upper position within the main body casing 2 and includes a laser emission unit (not shown), a polygon mirror 19 to be rotationally driven, lenses 20 and 21, and reflection mirrors 22 and 23. A laser beam emitted from the laser emission unit based on image data sequentially is passed through or reflected on the polygon mirror 19, the lens 20, the reflection mirror 22, the lens 21, and the reflection mirror 23, as indicated by a chain line. Then, the laser beam is radiated to the surface of the photosensitive drum 27 of the process cartridge 17 through a high-speed scan.

<Configuration of the Process Cartridge>

The process cartridge 17 detachably attached to the main body casing 2 by opening a front cover 2A provided on the front side of the main body casing 2. The process cartridge 17 mainly includes a developer cartridge 28 serving as an example of cartridge and a drum unit 51.

The developer cartridge 28 is detachably attached to the main body casing 2 by way of the drum unit 51; more specifically, removably attachable to the drum unit 51 attached to the main body casing 2. Attachment of the developer cartridge 28 to the main body casing 2 may also be performed by means of only the developer cartridge 28 or by means of the process cartridge 17 in which the drum unit 51 is attached to the developer cartridge 28.

The developer cartridge 28 mainly includes a developing roller 31, a layer thickness regulation blade 32, a supply roller 33, and a toner hopper 34. The toner in the toner hopper 34 is supplied to the developing roller 31 by the supply roller 33 after being agitated by the agitator 34. At this time, the toner is positively frictionally charged between the supply roller 33 and the developing roller 31. The toner supplied on the developing roller 31 enters between the layer thickness regulation blade 32 and the developing roller 31 in association with a rotation of the developing roller 31, to thus be supported on the developing roller 31 as a thin layer of given thickness. Details of the developer cartridge 28 will be described in detail later.

The drum unit 51 mainly includes a photosensitive drum 27, a scorotron charger 29, and a transfer roller 30.

The photosensitive drum 27 is rotatably supported on the casing of the drum unit 51. In the photosensitive drum 27, a drum main body is grounded, and a surface portion of the photosensitive drum is formed of a photosensitive layer possessing a positive charge characteristic.

The scorotron charger 29 is disposed opposite and spaced apart from the photosensitive drum 27 by a predetermined distance so as to avoid contact with the photosensitive drum 27. The scorotron charger 29 is a charger of scorotron type for positive charging purpose that generates a corona discharge from a charging wire, such as tungsten, and is formed so as to positively and uniformly charge the surface of the photosensitive drum 27.

The transfer roller 30 is disposed at a position below and opposite the photosensitive drum 27 such that the transfer roller 30 contacts with the photosensitive drum 27. The transfer roller 30 is rotatably supported by a casing of the drum unit 51. The transfer roller 30 includes a metal roller shaft with a conductive rubber material coated thereon. During transfer operation, a transfer bias is applied to the transfer roller 30 by means of constant-current control.

The surface of the photosensitive drum 27 is positively and uniformly charged by the scorotron charger 29 and subsequently exposed to a high-speed scan of the laser beam emitted from the scanner unit 16. Thus, an electric potential of the exposed area is reduced, whereby an electrostatic latent image is formed based on the image data. Here, the "electrostatic latent image" corresponds to an exposed area on the uniformly, positively charged surface of the photosensitive drum 27 whose electric potential is reduced due to the laser beam exposure. Next, the toner supported on the developing roller 31 is supplied to the electrostatic latent image formed on the surface of the photosensitive drum 27 when the toner on the developing roller 31 opposes to and contacts with the photosensitive drum 27 according to the rotation of the developing roller 31. The toner is selectively supported on the surface of the photosensitive drum 27, to thus form a visible image, whereby a toner image is formed through reversal development.

Subsequently, the photosensitive drum 27 and the transfer roller 30 are rotationally driven so as to convey the sheet 3 while nipping the sheet therein. As a result of the sheet 3 being conveyed between the photosensitive drum 27 and the transfer roller 30, the toner image supported on the surface of the photosensitive drum 27 is transferred onto the sheet 3.

<Configuration of the Fixing Unit>

The fixing unit 18 is disposed downstream of the process cartridge 17 with respect to the conveying direction of the sheet 3 and includes a heating roller 41 and a press roller 42 that presses the heating roller 41. In the fixing unit 18, the toner transferred onto the sheet 3 is thermally fixed during the pass of the sheet 3 between a heating roller 41 and a press roller 42. Subsequently, the sheet 3 thermally fixed by the fixing unit 18 is conveyed to a sheet discharge roller 45 disposed downstream of the fixing unit 18 and onto the sheet discharge tray 46 from the sheet discharge roller 45.

<Detailed Structure of the Developer Cartridge>

Figure 2:
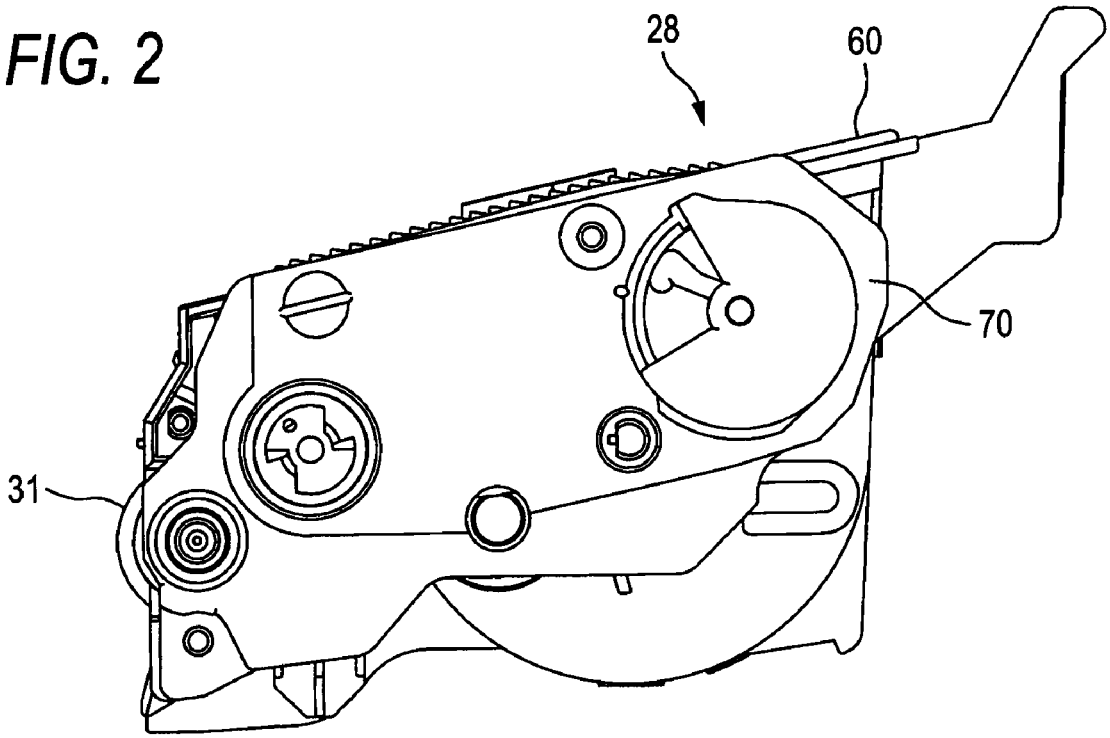
FIG. 2 is a side view showing a developer cartridge.
Figure 3:
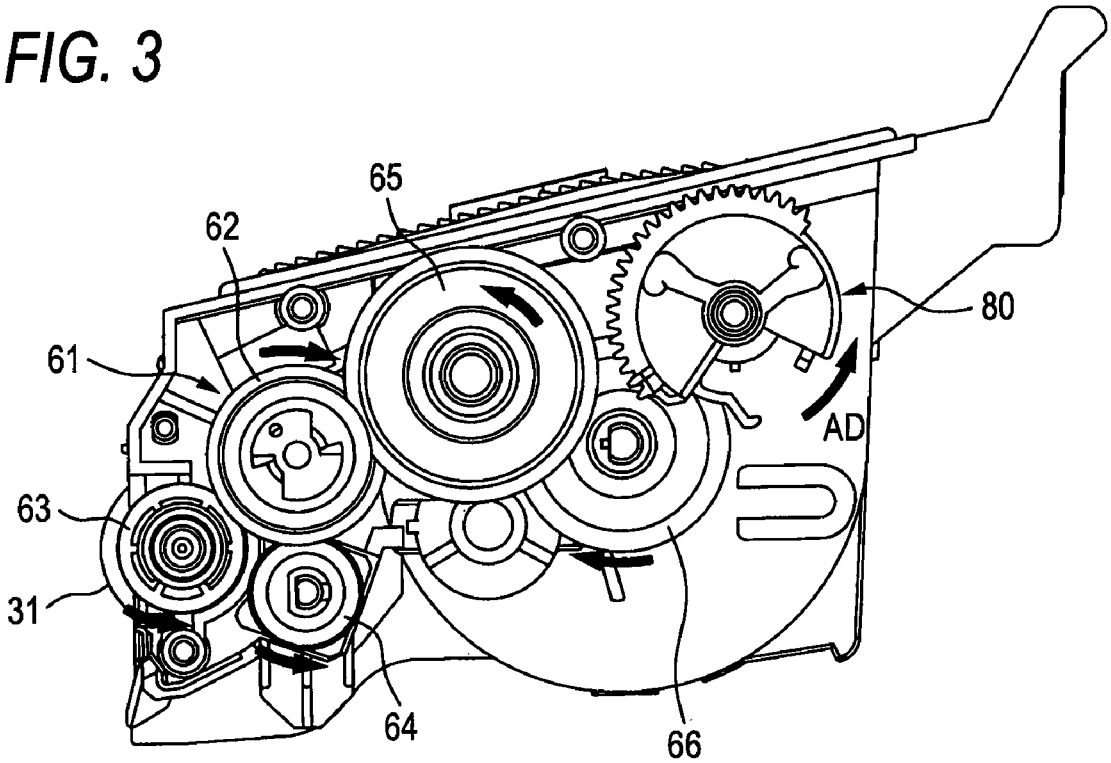
FIG. 3 is a side view showing the developer cartridge whose cover element is removed.
Figure 4:
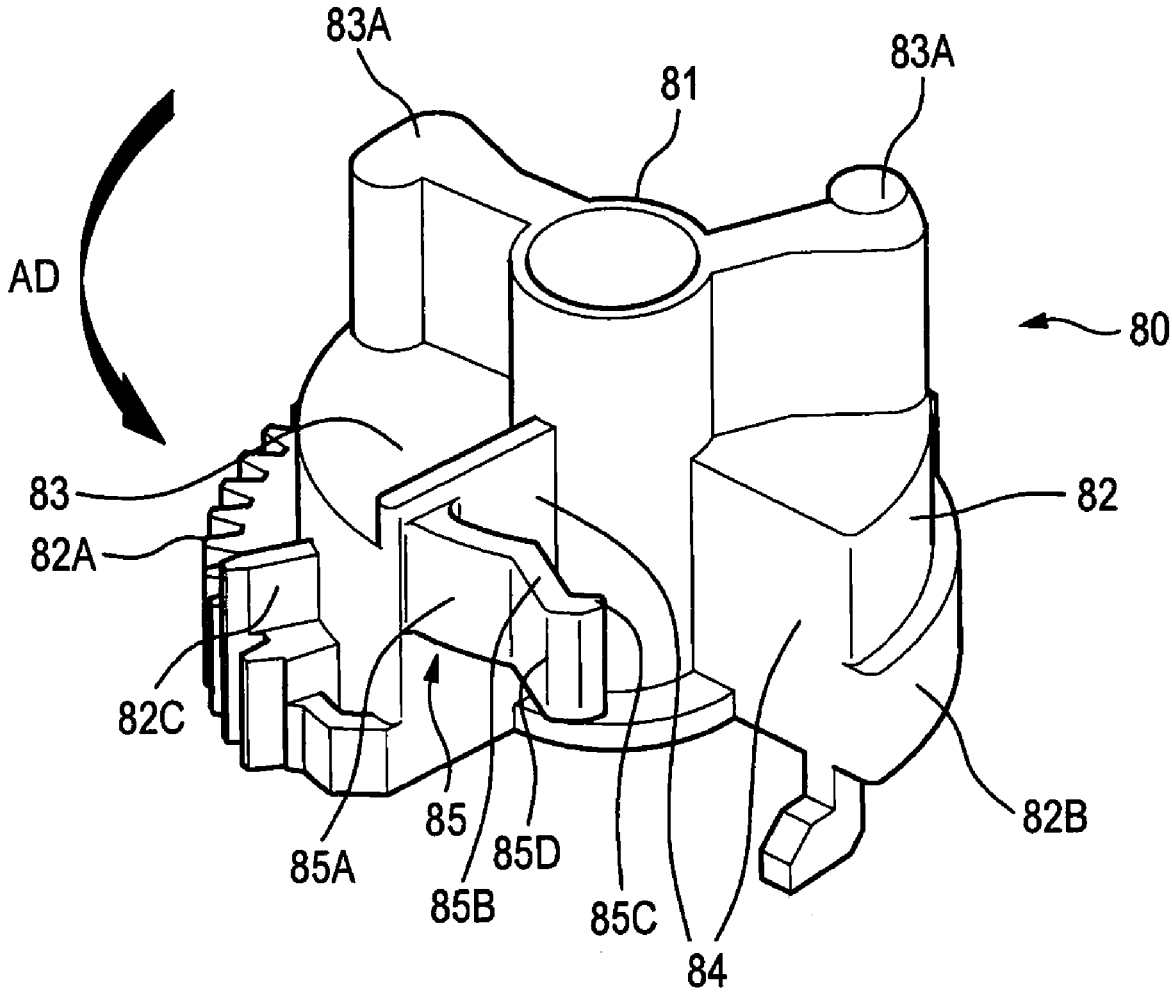
FIG. 4 is an enlarged perspective view showing a toothless gear.
Figure 5A:
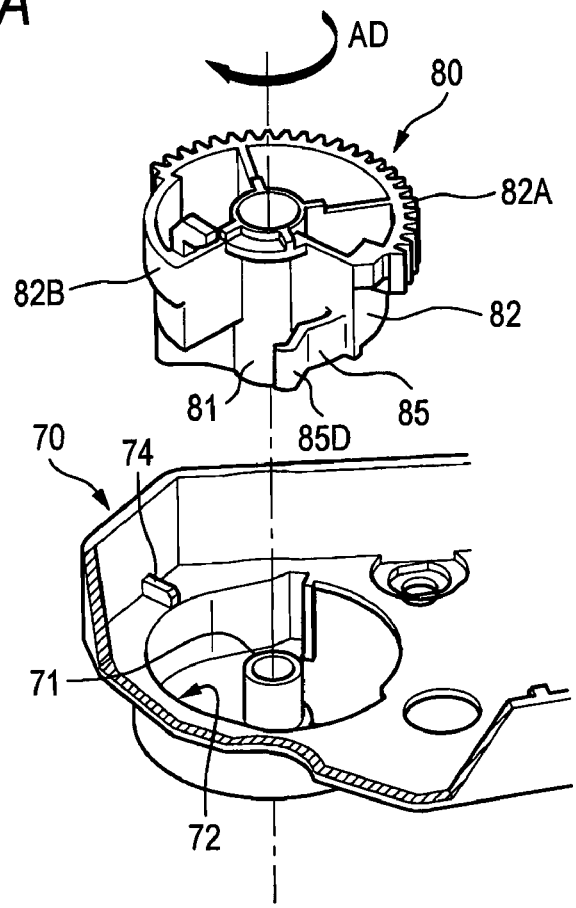
FIG. 5A is a perspective view showing the cover element and the toothless gear and FIG. 5B is an enlarged side view showing a storing recess portion formed in the cover element.
Figure 5B:
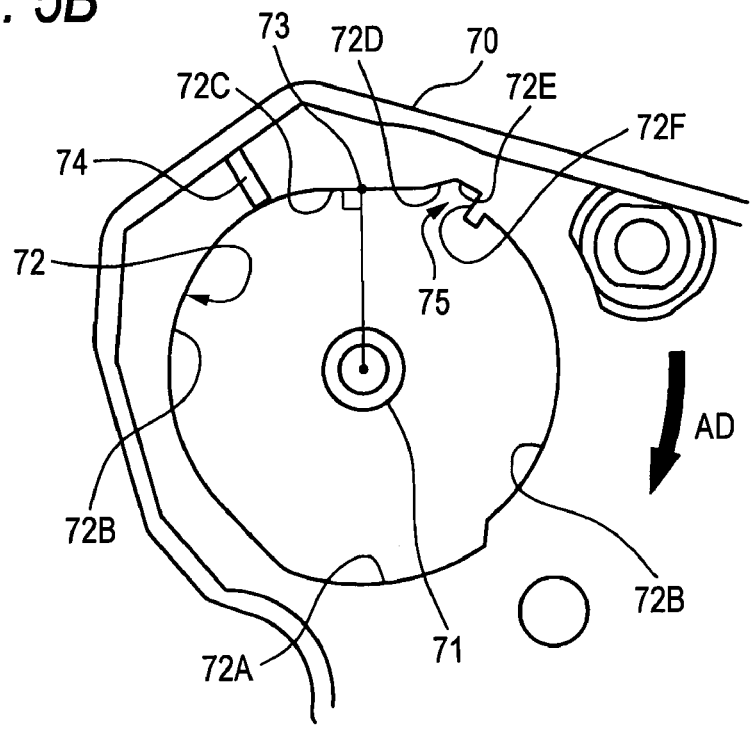

Next, a detailed structure of the developer cartridge 28 will be described. FIG. 2 is a side view showing a developer cartridge, and FIG. 3 is a side view showing the developer cartridge without cover element. FIG. 4 is an enlarged perspective view showing a toothless gear; FIG. 5A is a perspective view showing the cover element and the toothless gear; and FIG. 5B is an enlarged side view showing a storing recess portion formed in the cover element.

As shown in FIG. 2, the developer cartridge 28 includes a cartridge main body 60 serving as an example of a casing, and a cover element 70, in addition to the developing roller 31. The cover element 70 is removably attached to the cartridge main body 60. As shown in FIG. 3, a gear mechanism 61 and a toothless gear 80 serving as an example of a second gear are interposed between the cartridge main body 60 and the cover element 70. The gear mechanism 61 is configured to transmit drive force to other elements such as the developing roller 31. The toothless gear 80 can rotate irreversibly in one way direction AD (a counterclockwise direction in the drawing).

The gear mechanism 61 includes: an input gear 62 to which drive force is transmitted from a drive unit (not shown) disposed in the main body casing 2; a developing roller drive gear 63 and a supply roller drive gear 64 and that directly mesh with the input gear 62; and an agitator drive gear 66 that serves as an example of a first gear and meshes with the input gear 62 by way of an intermediate gear 65. The developing roller drive gear 63, the supply roller drive gear 64, and the agitator drive gear 66 are configured to drive the developing roller 31, the supply roller 33, and the agitator 34A shown in FIG. 1 and are provided integrally at ends of respective shafts of the developing roller 31, the supply roller 33, and the agitator 34A. The input gear 62 rotates clockwise as illustrated, and the developing roller drive gear 63 meshing with the input gear 62, the supply roller drive gear 64, and the intermediate gear 65 rotate counterclockwise. The agitator drive gear 66 meshing with the intermediate gear 65 rotates clockwise.

As shown in FIG. 4, the toothless gear 80 includes: a cylindrical inner cylinder portion 81; a C-shaped outer cylinder portion 82 that is larger in diameter than the inner cylinder portion 81; a C-shaped first joint wall 83 that connects an essentially-center portion of the inner cylinder portion 81 to a periphery of the outer cylinder portion 82; and a pair of second joint walls 84 that connects the inner cylinder portion 81 to both end portions of the first joint wall 83 and both end portions of the outer cylinder portion 82. In the following descriptions, a side of the outer cylinder portion 82 in which the inner cylinder portion 81 projects is referred to as a "leading-end side," and an opposite side of the outer cylinder portion is referred to as a "base-end side."

The inner cylinder portion 81 is rotatably supported by a cylindrical support shaft portion 71 formed on an inner surface of the cover element 70 shown in FIG. 5A.

The outer cylinder portion 82 is stored in a storing recess portion 72 formed by the inner surface of the cover element 70 shown in FIG. 5A. A gear tooth portion 82A capable of receiving rotational force transmitted from the agitator drive gear 66 as a result of meshing with the agitator drive gear 66 is formed on a part of the base-end side of the outer periphery of the outer cylinder portion 82. A toothless portion 82B incapable of meshing with the agitator drive gear 66 is formed in another (remaining) part of the outer periphery. A projection rib 82C is formed, as an example projection portion projecting radially outside, at an appropriate position on the outer peripheral surface of the outer cylinder portion 82 (in the vicinity of a downstream end of the gear tooth portion 82A in the direction of rotation of the toothless gear 80).

Contact projections 83A that extend radially outside from the inner cylindrical portion 81 and that are used for detecting a new product and type are formed on the first joint wall 83. The number of contact projection 83A is determined in accordance with type.

An arm portion 85 extending in a direction (one direction AD) in which the toothless gear 80 rotates is formed on one of the pair of second joint walls 84.

The arm portion 85 includes: a base portion 85A aligned with the direction of rotation of the toothless gear 80; a first inclined surface portion 85B that is tilted in a radially outward direction with an increasing distance from the leading end of the base portion 85A in the one direction AD; and a second inclined surface portion 85C that is tilted in a radially inward direction with an increasing distance from leading end of the first inclined surface portion 85B in the one direction AD. An angular portion 85D defined by the first inclined surface portion 85B and the second inclined surface portion 85C comes into slidable contact, as necessary, with an inner peripheral surface of the storing recess portion 72 of the cover element 70 to be described in detail later, to thus become depressed in a radially inward direction. Thereby, the arm portion 85 is resiliently deformed in an essentially diametrical direction of the toothless gear 80 while taking the base end of the base portion 85A as a substantial center.

As shown in FIG. 5A, the cover element 70 includes: a support shaft portion 71 configured to rotatably support the toothless gear 80; and a cylindrical closed-end storing recess portion 72 that houses a portion of the toothless gear 80. As shown in FIG. 5B, an inner peripheral surface of the storing recess portion 72 includes a large-diameter surface portion 72A, an intermediate-diameter surface portion 72B, a plane surface portion 72C, an inclined surface portion 72D, a distantly-separated surface portion 72E, and a longitudinal wall surface portion 72F.

The large-diameter surface portion 72A has a curved surface in which a distance (a diameter) from the center of the support shaft portion 71 becomes longer than a distance from the center of the toothless gear 80 shown in FIG. 4 to the angular portion 85D of the arm portion 85 that is in a non-deformed state (hereinafter referred to as "non-deformed arm portion 85"). Therefore, when the non-deformed arm portion 85 opposes the large-diameter surface portion 72A, the arm portion 85 and the large-diameter surface portion 72A remain out of contact with each other.

The intermediate-diameter surface portions 72B are formed continually to a side of the large-diameter surface portion 72A toward the one direction AD (hereinafter called the "one-direction-AD side") and an opposite side of the one-direction-AD side. Each of the intermediate-diameter surface portions is formed to become smaller in diameter than the large-diameter surface portion 72A. In particular, in the present embodiment, the intermediate-diameter surface portion 72B has a diameter of the order of magnitude which causes the intermediate-diameter portion 72B to contact the arm portion 85 of the toothless gear 80, to thus slightly deflect the arm portion 85.

The plane surface portion 72C is formed continually on the one-direction-AD side of the intermediate-diameter surface portion 72B and so as to cross at right angles the radial direction of the support shaft portion 71. In other words, the plane surface portion 72C has a plane that gradually approaches the center of the support shaft portion 71 from the intermediate-diameter surface portion 72B and that gradually departs from the center of the support shaft portion 71 from a predetermined position with reference to a the one direction AD. Now, the predetermined position where the distance from the center of the support shaft portion 71 changes from a decreasing tendency to an increasing tendency corresponds to a point 73 in the plane surface portion 72C that is closest to the center of the support shaft portion 71. The point 73 will be hereunder referred to as a "peak portion 73."

The inclined surface portion 72D is formed continually on the one-direction-AD side of the plane surface portion 72C so as to become tilted radially outside with an increasing distance from the plane surface portion 72C toward the one-direction-AD side.

The distantly-separated surface portion 72E is formed continually on the one-direction-AD side of the inclined surface portion 72D and at a position distant from the center of the support shaft portion 71 rather than from the plane surface portion 72C. Specifically, the distantly-separated surface portion 72E is slightly smaller in diameter than the large-diameter surface portion 72A and greater in diameter than the intermediate-diameter surface portion 72B; and does not contact the angular portion 85D of the arm portion 85 that enters a non-deformed state. Thereby, since the arm portion 85 returns to a non-deformed state after having deflected maximum at the peak portion 73 (an amount of change resultant from defection is large), restoration force of deflection can be utilized to the greatest extent possible.

The longitudinal wall surface portion 72F is formed continually on the one-direction-AD side of the distantly-spaced surface portion 72E so as to extend toward the center of the support shaft portion 71.

An area including a part of the plane surface portion 72C and a part of the inclined surface portion 72D (an area located radially inside with respect to the intermediate-diameter surface portion 72B) bulges radially inside than does the intermediate-diameter surface portion 72B, thereby forming a bulging portion that contacts the angular portion 85D (an end portion) of the arm portion 85 of the toothless gear 80. Therefore, amounts of deflection of the arm portion 85 that moves in association with the rotation of the toothless gear 80 in the one direction AD is switched from an increasing tendency to a decreasing tendency while the peak portion 73 of the plane surface portion 72C is taken as a base point.

A regulation portion 74 is provided outside of the storing recess potion 72, more specifically, outside of a corner portion formed from the intermediately-diameter surface portion 72B and the plane surface portion 72C. The regulation portion 74 is configured to engage with the projection rib 82C of the toothless gear 80 after the toothless gear 80 has finished rotating independently, to thus regulate the rotation of the toothless gear 80 in the one direction AD. As a result, excessive rotation of the toothless gear 80 that rotates in the one direction AD is prevented.

Moreover, an engagement recess portion 75 that engages with the angular portion 85D of the arm portion 85 of the toothless gear 80 is defined by: the part of the inclined surface portion 72D described above (i.e., the area located radially outside than is the intermediate-diameter portion 72B), the distantly-spaced surface portion 72E, and the longitudinal wall surface portion 72F. Therefore, excessive rotation of the toothless gear 80 that rotates in the one direction AD is reliably regulated as a result of the arm portion 85 engaging with the engagement recess portion 75 as well as by means of regulating action performed by the regulation portion 74.

Moreover, the engagement recess portion 75 also regulates the rotation of the toothless gear 80 in a direction opposite to the one direction AD.

Figure 6A:
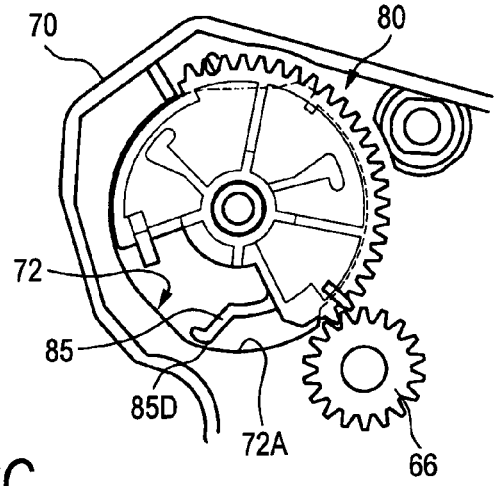
FIG. 6A is a side view showing a state where the toothless gear is situated at an initial position.
Figure 6B:
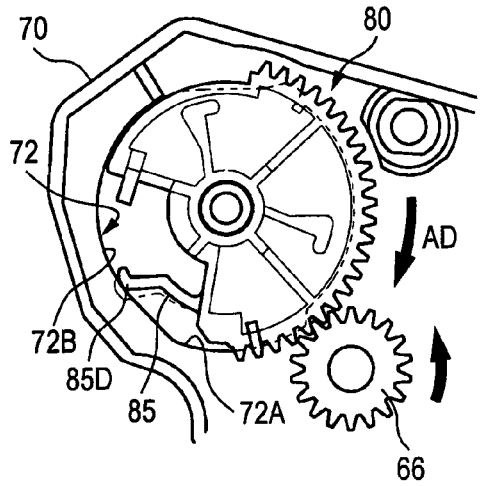
FIG. 6B is a side view showing a state where an angular portion of the arm portion is situated at the intermediate-diameter surface portion.
Figure 6C:
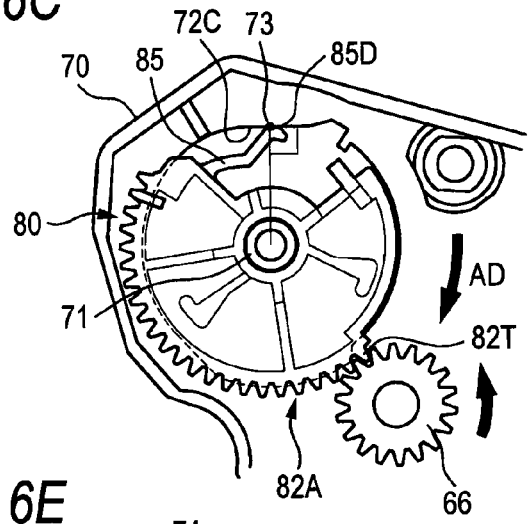
FIG. 6C is a side view showing a state where the angular portion of the arm portion is situated at the peak portion.
Figure 6D:
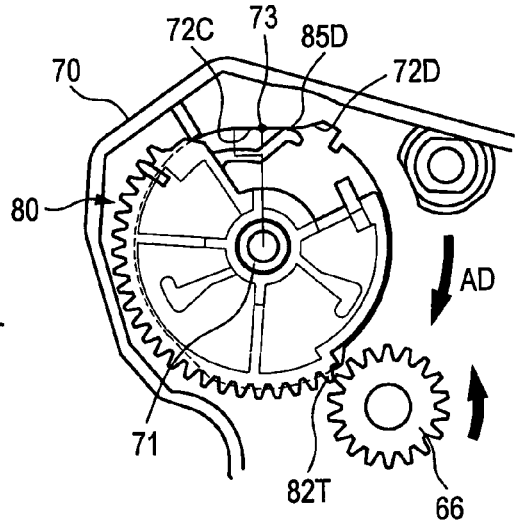
FIG. 6D is a side view showing a state where the angular portion of the arm portion has crossed the peak portion.
Figure 6E:
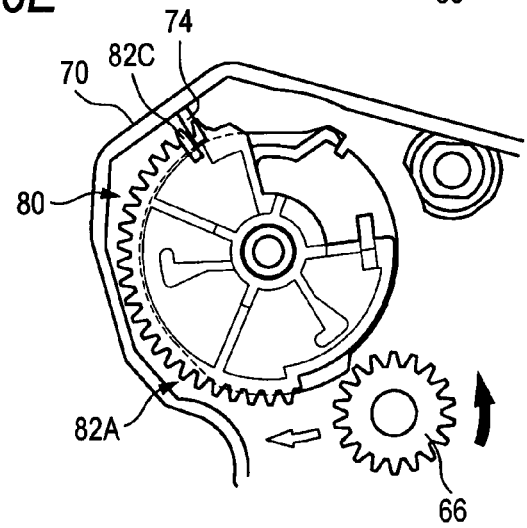
FIG. 6E is a side view showing a state where the angular portion of the arm portion is situated at the corner portion defined by the inclined surface portion and the distantly-separated surface portion.

Some advantages of the toothless gear 80 and the storing recess portion 72 of the present embodiment will now be described. FIG. 6A is a side view showing a state where the toothless gear is situated at an initial position; FIG. 6B is a side view showing a state where an angular portion of the arm portion is situated at the intermediate-diameter surface portion; FIG. 6C is a side view showing a state where the angular portion of the arm portion is situated at the peak portion; FIG. 6D is a side view showing a state where the angular portion of the arm portion has crossed the peak portion; and FIG. 6E is a side view showing a state where the angular portion of the arm portion is situated at the corner portion of the arm portion defined by the inclined surface portion and the distantly-separated surface portion.

As shown in FIG. 6A, when the developer cartridge 28 is not used, the toothless gear 80 is situated at the initial position where the angular portion 85D of the arm portion 85 opposes an appropriate portion of the large-diameter surface portion 72A of the storing recess portion 72. The arm portion 85 is maintained, at the initial position, in a non-deformed state without contacting the internal peripheral surface (the large-diameter surface portion 72A) of the storing recess portion 72. Hence, when compared with a mode in which the arm portion is maintained in a deformed state at the initial position, restoration force of the arm portion 85 to be described later can be exhibited without fail.

When the developer cartridge 28 is attached to the main body casing 2 (see FIG. 1) and when the idle rotation operation is started, the toothless gear 80 rotates in the one direction AD as shown in FIGS. 6A and 6B, whereupon the angular portion 85D of the arm portion 85 moves from the large-diameter surface portion 72A to the intermediate-diameter surface portion 72B. As a result, the angular portion 85D of the arm portion 85 is slightly pushed radially inside by a slope portion connecting the large-diameter surface portion 72A to the intermediate-diameter surface portion 72B or by the intermediate-diameter surface portion 72B, whereupon the arm portion 85 is slightly deformed by a predetermined amount.

Subsequently, when the toothless gear 80 is further rotated, the angular portion 85D of the arm portion 85 is gradually moved radially inside by means of the plane surface portion 72C, as shown in FIG. 6C, and approaches most closely the center of the support shaft portion 71 at the peak portion 73. As a result, the arm portion 85 exhibits maximum deflection at the peak portion 73. In the present embodiment, since the arm portion 85 extends substantially in the peripheral direction of the toothless gear 80, the arm portion 85 does not substantially become deformed in the peripheral direction and becomes deformed in the radially inward direction. At this time, the agitator drive gear 66 meshes with only one gear tooth 82T, in the gear tooth portion 82A of the toothless gear 80, located at the end in the direction of the rotation of the toothless gear 80.

As shown in FIG. 6D, when the toothless gear 80 is rotated further, the gear tooth 82T located at the end is pushed in the one direction AD by means of the agitator drive gear 66, whereupon the gear tooth portion 82A is disengaged from the agitator drive gear 66. At this time, the angular portion 85D of the arm portion 85 crosses the peak portion 73 in the one direction AD. Thereby, the arm portion 85 restores in the radially outward direction. Restoration force resultant from restoring action acts on the plane portion 72C (more specifically, the one-direction-AD side of the peak portion 73) and the inclined surface portion 72D that gradually depart from the center of the support shaft portion 71, whereby the toothless gear 80 independently rotates by a predetermined amount even when rotational force is not transmitted to the toothless gear 80 from the agitator drive gear 66, as shown in FIGS. 6D and 6E. As mentioned above, the gear tooth portion 82A of the toothless gear 80 departs from the agitator drive gear 66 by a predetermined amount, thereby preventing re-engagement of the gear tooth portion 82A with the agitator drive gear 66. Further, the rotation of the toothless gear 80 that rotates independently is regulated as a result of the projection rib 82C contacting the regulation portion 74 and is held at a desired position.

According to the above descriptions, the following advantages can be obtained by the present embodiment.

Deflection of the arm portion 85 in the peripheral direction is prevented by extending the arm portion 85 substantially in the peripheral direction thereof, whereby the angular portion 85D of the arm portion 85 crosses the peak portion 73 thoroughly. Hence, generation of flipping sound, which would otherwise be caused as a result of the toothless gear 80 engaging with the agitator drive gear 66 after the new product detection, can be prevented reliably.

The angular portion 85D of the arm portion 85 engages with the engagement recess portion 75 defined by a portion of the inclined surface portion 72D (the area located radially outside with reference to the intermediate-diameter surface portion 72B), the distantly-separated surface portion 72E, and the longitudinal wall surface portion 72F, thereby regulating the rotation of the toothless gear 80 in the one direction AD or the other direction. Therefore, re-engagement of the toothless gear 80 with the agitator drive gear 66 can be prevented.

The large-diameter surface portion 72A is liberated radially outside so as not to contact the angular portion 85D of the non-deformed arm portion 85, so that loss of elasticity (elastic deformation) of the arm portion 85, which would otherwise be induced when the developer cartridge 28 is used, can be prevented. Therefore, when the developer cartridge 28, restoration force of the arm portion 85 when the arm portion has crossed the peak portion 73 can be exhibited reliably, and independent rotation of the toothless gear 80 can be realized without fail.

After completion of independent rotation of the toothless gear 80, the projection rib 82C of the toothless gear 80 engages with the regulation portion 74 of the cover element 70, and hence excessive rotation of the toothless gear 80 is prevented reliably. Excessive rotation of the toothless gear 80 can also be prevented by means of the end portion of the arm portion 85 engaging with the longitudinal wall surface portion 72F that defines the engagement recess portion 75. Even if the end portion of the arm portion 85 fails to catch the longitudinal wall surface portion 72F as a result of loss of elasticity of the arm portion 85, excessive rotation of the toothless gear 80 can be reliably prevented as in the present embodiment, by adoption of a configuration in which the projection rib 82C provided separately from the arm portion 85 is engaged with the regulation portion 74 formed outside of the storing recess portion 72.

Since the peak portion 73, where the maximum amount of deflection of the arm portion 85 is achieved, is located on a portion of (an essentially-intermediate position on) the plane surface portion 72C, switching of elastic deformation of the arm portion 85 is performed smooth when compared with the structure where the peak portion is embodied as an angular portion, and the arm portion can further be prevented from catching the peak portion.

The present invention is not limited to the embodiment and can be utilized in various modes as illustrated below.

In the present embodiment, the arm portion 85 is extended substantially in the one direction AD (substantially toward a downstream in the direction of rotation of the toothless gear 80). The present invention is not limited to the embodiment, and the arm portion may also be extended in another direction. When the arm portion 85 is extended in the one direction AD as in the embodiment, amounts of independent rotation of the toothless gear 80 can be increased when compared with the case where the arm portion is extended in the other direction, as will be described in detail below.

Figure 7A:
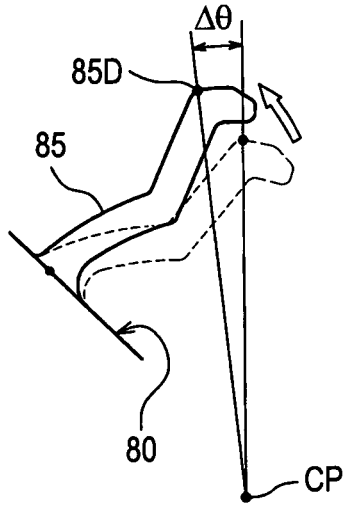
FIG. 7A is a side view showing displacement of the angular portion achieved from when the arm portion is deformed maximum until when the arm portion returns to an non-deformed state.
Figure 7B:
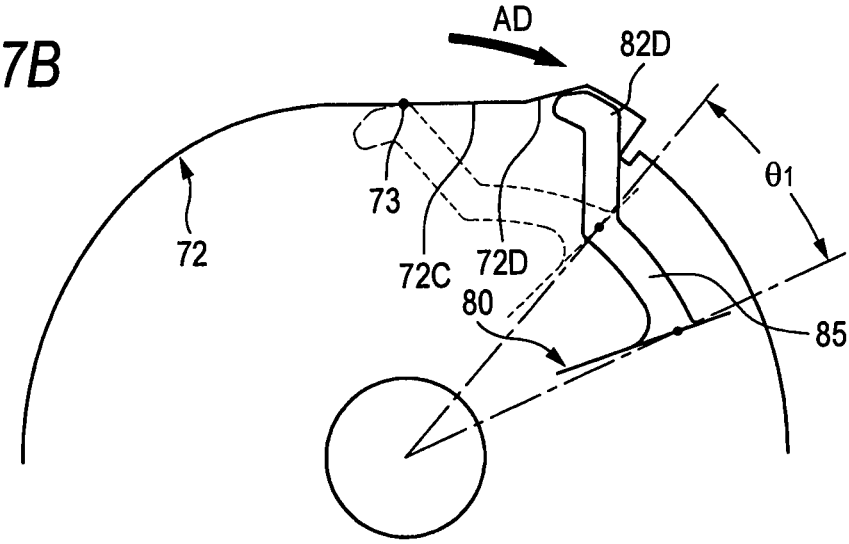
FIG. 7B is a side view showing amounts of rotation of the toothless gear when the arm portion is oriented in a direction opposite to the direction of rotation of the toothless gear.

The foregoing advantages will be described hereunder with reference to FIG. 7. FIG. 7A is a side view showing displacement of the angular portion achieved from when the arm portion is deformed maximum until when the arm portion returns to a non-deformed state; FIG. 7B is a side view showing amounts of rotation of the toothless gear when the arm portion is oriented in a direction opposite to the direction of rotation of the toothless gear; and FIG. 7C is a side view showing amounts of rotation of the toothless gear when the arm portion is oriented in the direction of rotation of the toothless gear.

As shown in FIG. 7A, when the arm portion 85 returns from the maximum-deformed state to the non-deformed state, the angular portion 85D of the arm portion 85 moves in a direction opposite to the direction where the arm portion 85 extends, by an amount corresponding to an amount of rotation $\Delta\theta$ around the rotation center CP of the toothless gear 80. Therefore, as shown in FIG. 7B, when the arm portion 85 extends substantially in a direction opposite to the direction of rotation of the toothless gear 80 (in the one direction AD), the angular portion 85D of the arm portion 85 advances in the direction of rotation of the toothless gear 80 by means of restoration of deflection of the arm portion 85 by the amount $\Delta\theta$. Thereby, when the angular portion 85D moves in the engagement recess portion 75, the toothless gear 80 does not need to rotate by an amount ($\Delta\theta$) over which the angular portion 85 has advanced. Hence, an amount of rotation of the toothless gear 80 comes to a small value $\theta 1$.

Figure 7C:
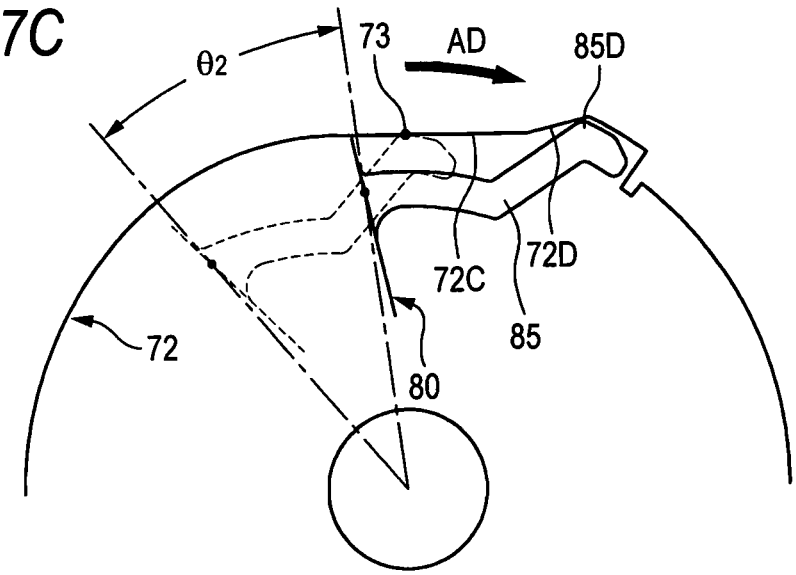
FIG. 7C is a side view showing amounts of rotation of the toothless gear when the arm portion is oriented in the direction of rotation of the toothless gear.
Figure 8:
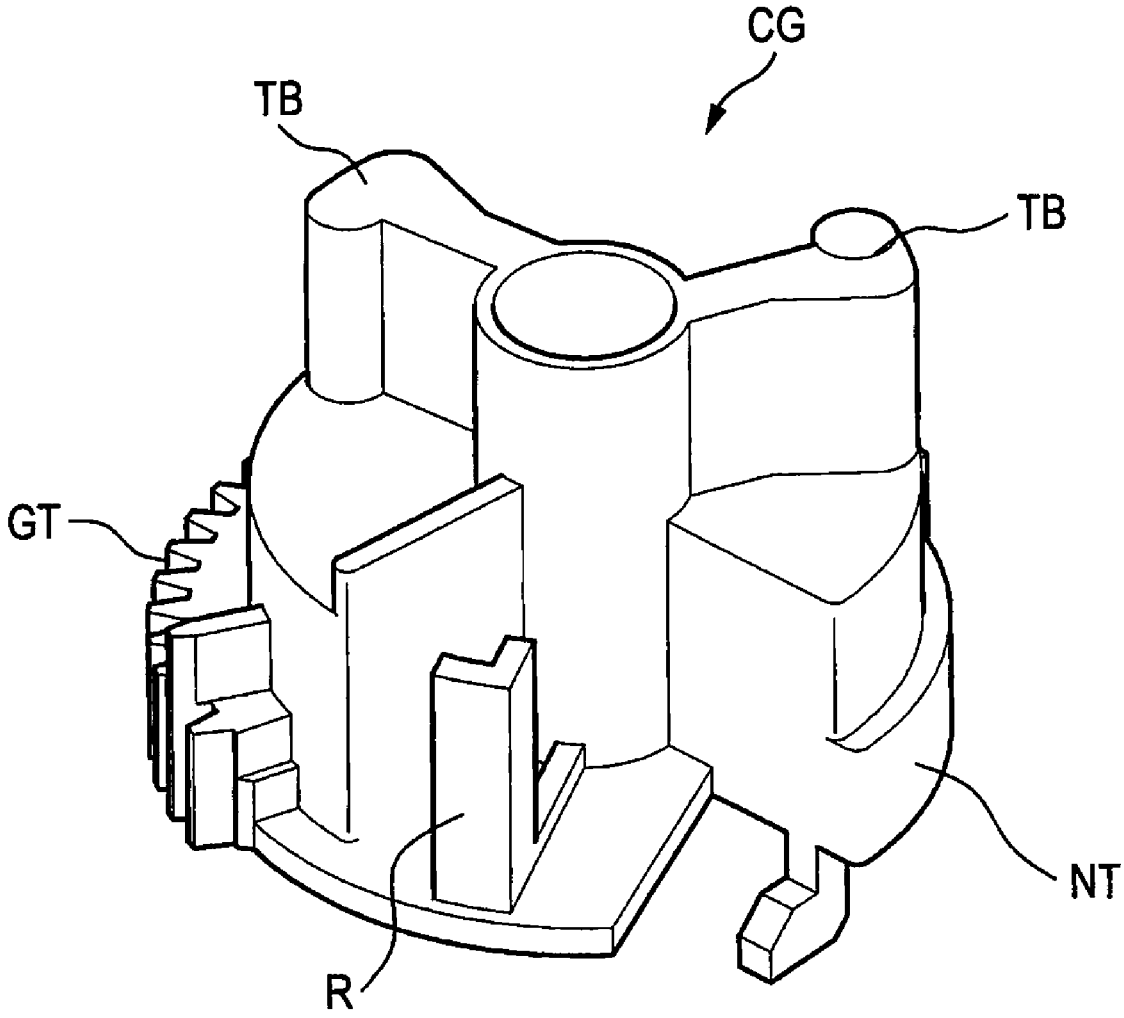
FIG. 8 is a perspective view showing an example of a related-art toothless gear.
Figure 9A:
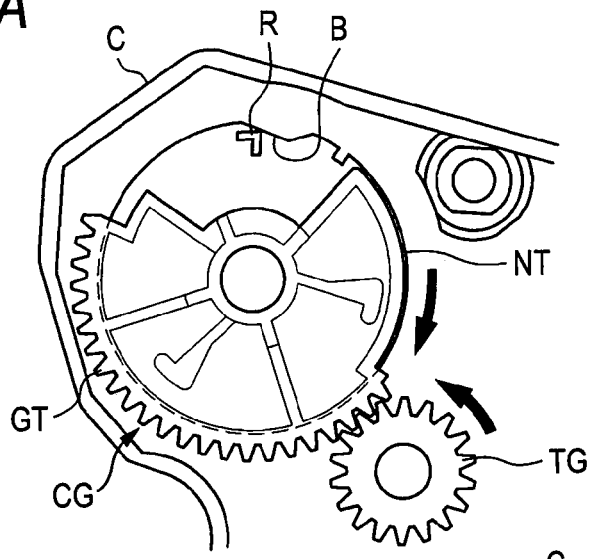
FIG. 9A is a side view showing a state where a detection gear is situated at an initial position.
Figure 9B:
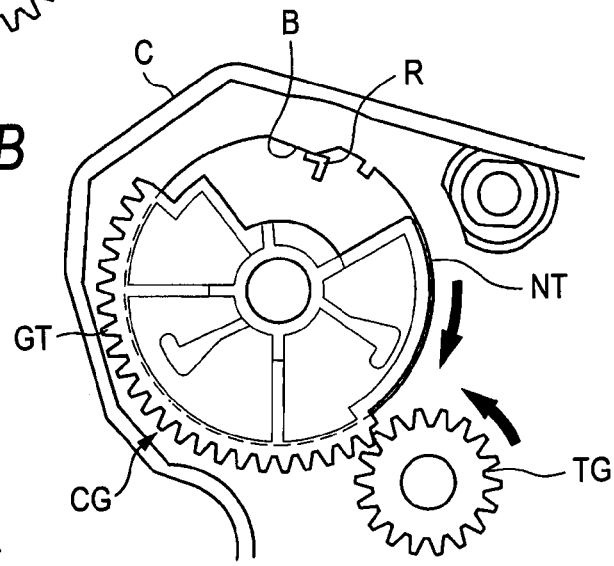
FIG. 9B is a side view showing a state where a rib of the detection gear is deflected maximumly as a result of being situated at a peak of a projection portion.
Figure 9C:
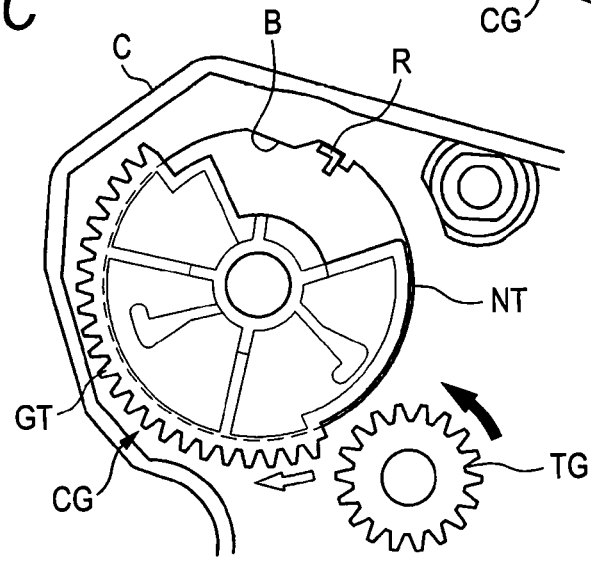
FIG. 9C shows a state where the detection gear rotates independently by means of restoration force of the rib.

As shown in FIG. 7C, when the direction of extension of the arm portion 85 is substantially identical with the direction of rotation of the toothless gear 80, the angular portion 85D of the arm portion 85 recedes in a direction opposite to the direction of rotation of the toothless gear 80 by $\Delta\theta$ by means of restoration of deflection of the arm portion 85. As a result, when the angular portion 85D moved to the engagement recess portion 75, the toothless gear 80 is rotated in the direction of rotation by an amount ($\Delta\theta$) over which the angular portion 85 has receded, so that the amount of rotation of the toothless gear 80 can be set to $\theta 2$ that is greater than $\theta 1$.

Moreover, when the arm portion 85 becomes deflected from the non-deformed state as shown in FIG. 7A, the angular portion 85D of the arm portion 85 moves by $\Delta\theta$ in the direction where the arm portion 85 extends. Therefore, when the direction of extension of the arm portion 85 is identical with the direction of rotation of the toothless gear 80 as shown in FIG. 7C, the angular portion 85D gradually moves ahead in an advancing direction in accordance with deformation of the arm portion 85 during the course of the angular portion 85D crossing the peak portion 73. Hence, the angular portion 85D becomes easy to cross the peak portion 73, so that independent rotation of the toothless gear 80 can be performed without fail.

In the present embodiment, the peak portion 73 is set as a portion of the plane surface portion 72C. However, the present invention is not limited to the embodiment, and an angle may also be set as a peak portion.

In the present embodiment, the developer cartridge is adopted as the cartridge. However, the present invention is not limited to the embodiment. For instance, when a developer cartridge and a drum unit are configured integrally, a process cartridge may also be adopted. Further, a toner cartridge that does not have a developing roller, a supply roller, or the like, and that houses primarily toner may also be adopted. Still further, a cartridge which does not accommodate a developer, such as a drum cartridge which include a drum unit and to which a toner cartridge or a developer cartridge is detachably attachable, may also be adopted.

In the embodiment, the angular portion 85D formed by bending the end portion of the arm portion 85 is adopted as the end portion of the arm contacting the internal peripheral surface of the storing recess portion. However, the present invention is not limited to the embodiment. The end portion may also be brought into contact with the inner peripheral surface of the storing recess portion without being bent.

What is claimed is:

1. A cartridge comprising:

a casing;

a first gear rotatably provided at the casing;

a second gear including a toothed portion and a toothless portion, the toothed portion being provided on a part of an outer periphery of the second gear and configured to mesh with the first gear, and the toothless portion being provided on a remaining part of the outer periphery of the second gear and configured to be free from meshing with the first gear; and a storing portion formed at the casing and configured to store the second gear, the storing portion including an inner peripheral surface that faces the second gear, wherein the second gear comprises an arm that is flexible and extends substantially along a peripheral direction of the second gear, wherein the inner peripheral surface includes a bulging portion that bulges inward in a radial direction of the second gear and is allowed to contact an end portion of the arm, wherein the bulging portion has a peak portion that is closest to a rotation center of the second gear, wherein the arm moves in association with a rotation of the second gear in one direction and is deflected while the arm contacts the bulging portion, wherein a change tendency of deflection amounts of the arm is changed from an increasing tendency to a decreasing tendency at the peak portion as a base point, and wherein the toothed portion of the second gear is separated from the first gear when the end portion of the arm has crossed over the peak portion of the bulging portion in the one direction.

2. The cartridge according to claim 1, wherein the arm extends substantially in the one direction.

3. The cartridge according to claim 1, wherein the inner peripheral surface of the storing portion includes an engagement recess portion provided at a downstream side in the one direction of the bulging portion and configured to engage with the end portion of the arm.

4. The cartridge according to claim 1, wherein the inner peripheral surface of the storing portion includes an area which opposes the end portion of the arm when the second gear is situated at an initial position, and wherein the area is displaced outward in the radial direction such that the area is spaced from the end portion of the arm in a non-deformed state.

5. The cartridge according to claim 1, wherein the second gear includes a projection portion projecting outward in the radial direction of the second gear; and wherein the casing includes a regulation portion provided outside the storing portion and configured to engage with the projection portion when or after the gear tooth portion of the second gear is separated from the first gear, thereby regulating a rotation of the second gear in the one direction.

6. The cartridge according to claim 1, wherein the bulging portion includes a flat portion containing the peak portion, the flat portion extends orthogonal to the radial direction of the second gear.

7. The cartridge according to claim 1, wherein the inner peripheral surface of the storing portion includes an area which opposes the end portion of the arm during a rotation of the second gear from an initial position in the one direction, the area of the inner peripheral surface including: a large-diameter surface portion, an intermediate-diameter surface portion, a plane surface portion, an inclined surface portion, a distantly-separated surface portion and a longitudinal wall surface portion, which are continuously provided in this order in the one direction, wherein the large-diameter surface portion has a diameter greater than a distance from a center of the second gear to the end portion of the arm in a non-deformed state;

wherein the intermediate-diameter surface portion has a smaller diameter than the large-diameter surface portion;

wherein, on the plane surface portion, a distance between the plane surface portion and the center of the gear gradually decreases toward the one direction from a boundary with the intermediate-diameter surface portion and gradually increases with respect to the one direction from a predetermined position at the plane surface portion;

wherein the inclined surface portion is tilted outward in the radial direction toward the one direction from the plane surface portion;

wherein the distantly-separated surface portion is distant from a center of the second gear than from the plane surface portion, and wherein the longitudinal wall surface portion extends toward the center of the second gear.

* * * * *